United States Patent [19]

Maury

[11] 4,374,494

[45] Feb. 22, 1983

[54] ELECTRO-MAGNETIC DECOY-LAUNCHER AMMUNITION

[75] Inventor: Louis Maury, Toulouse, France

[73] Assignee: Societe E. Lacroix-Tous Artifices, France

[21] Appl. No.: 198,636

[22] Filed: Oct. 20, 1980

[30] Foreign Application Priority Data

Nov. 9, 1979 [FR] France ..... 79 27681

[51] Int. Cl.[3] ..... F42B 4/00

[52] U.S. Cl. ..... 102/357; 102/351; 102/505

[58] Field of Search ..... 102/342, 351, 357, 505

[56] References Cited

U.S. PATENT DOCUMENTS

| | | | |
|---|---|---|---|
| 3,430,533 | 3/1969 | Kifor et al. | 102/357 X |
| 3,741,125 | 6/1973 | La Pointe | 102/505 X |
| 3,744,425 | 7/1973 | Grimm | 102/505 X |
| 3,780,656 | 12/1973 | Murray | 102/357 |
| 3,797,394 | 3/1974 | Thurston et al. | 102/357 |
| 4,222,306 | 9/1980 | Maury | 102/342 X |
| 4,307,665 | 12/1981 | B lock et al. | 102/357 X |

FOREIGN PATENT DOCUMENTS

| | | | |
|---|---|---|---|
| 2343990 | 10/1977 | France | 102/505 |

*Primary Examiner*—Peter A. Nelson

*Attorney, Agent, or Firm*—Thomas J. Greer, Jr.

[57] ABSTRACT

Electro-magnetic decoy-launcher ammunition has an external housing, which houses an impeller in its lower section and encloses a charge of electro-magnetic decoy material which can be ejected by a thrust device when the impeller is excited. The charge remains in its tubular transfer container, and the thrust device is mounted within the transfer container and comprises a semi-rigid disc actuated by a piston, fitted with a peripheral projection, which defines with the disc an annular housing for a split ring for taking up play and a felt washer ensuring that the device is fireproof.

5 Claims, 7 Drawing Figures

ELECTRO-MAGNETIC DECOY-LAUNCHER AMMUNITION

BACKGROUND OF THE INVENTION

1. Field of the Invention

The present invention relates to electro-magnetic decoy-launcher ammunition.

2. Description of the Prior Art

Previously proposed electro-magnetic decoy-launcher ammunition presents difficulties in manufacture as regards the loading of the decoy charge, at least with small-size ammunition. The charge has to be transferred from its transport container into the ammunition, and this operation is a particularly delicate one, if it is desired to retain fully the structure and functional arrangement.

SUMMARY OF THE INVENTION

According to the invention there is provided electro-magnetic decoy-launcher ammunition, comprising an outer body having a lower portion, impeller means in said lower portion of said body, thrust means, a charge of electromagnetic decoy enclosed in said body to be ejected by said thrust means when the impeller means is excited, means defining a tubular transfer container in which the charge remains inside the outer body, said transfer container having a bottom portion, said thrust means comprising a thrust piston in said bottom portion of the transfer container, said thrust piston including means defining an internal downwardly directed recess, peripheral sealing means for providing a seal against the inner surface of the transfer container, a top defining a plane surface, and a semi-rigid disc co-operating with the plane surface of the thrust piston and in contact with the charge on its other side, said impeller means being disposed to cause the propelling agent to co-operate with the internal recess of the thrust piston.

The decoy charge thus remains in its tubular transfer container, and for the purpose, the outer body of the ammunition is adjusted internally so as to be able to house this tubular container precisely. Provision is made at the bottom section of the tubular container for a thrust piston, internally recessed downwards, and fitted with peripheral sealing means relative to the inner wall of the tubular container. The top of the thrust piston defines a plane surface which co-operates with a semi-rigid disc which is in contact with the charge on its other side, to impart to the charge a thrusting force which does not destroy their plane arrangement.

Usually the tubular container for charge transfer is made of plastics material. However, generally, great difficulties are encountered in satisfactorily ejecting a charge contained inside a cylinder of plastics material. The difficulties are increased with ammunition of the type under consideration as the transfer container of plastics material is frequently provided with a transverse sawing line, which permits the adjustment by cutting of the length of some of the flakes constituting the electro-magnetic decoy charge. Moreover, the adjustment of the thrust means at the bottom portion of a cylinder of plastics material is also a delicate operation, as it is imperative to avoid the passage of gases outside the thrust piston, using a slight deformation of the plastics material, and to ensure, on the contrary, that the gases should be applied solely to the thrust means which, alone, is going to ensure the ejection of the decoy charge. A preferred embodiment to be described avoids these difficulties.

In the preferred embodiment, the thrust piston comprises an upper part which has a diameter smaller than the inner diameter of the tubular container. This upper part is solid with a bottom part which projects radially outwards, and has a maximum diameter close to the inner diameter of the tubular container. In the annular space thus provided between the projection of the piston and the semi-rigid disc, a fire-proof washer, on the projection side, followed by a split ring for taking up play, on the semi-rigid disc side, are housed as a tight fit.

The tubular container may be held inside the ammunition casing, preferably by crimping at the upper end, and an ejectable sealing plug is preferably mounted at the top of the unit, and which is also advantageously secured by crimping.

For its part, the impeller preferably comprises a detonator and an ejection charge which are both of a gas-producing type, while fluid laminating means are placed between them.

In the case already referred to where the tubular container has a slit made to adjust, by cutting, the length of parts of the decoy charge, provision is made for sealing the slit by means of a reinforced adhesive tape.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
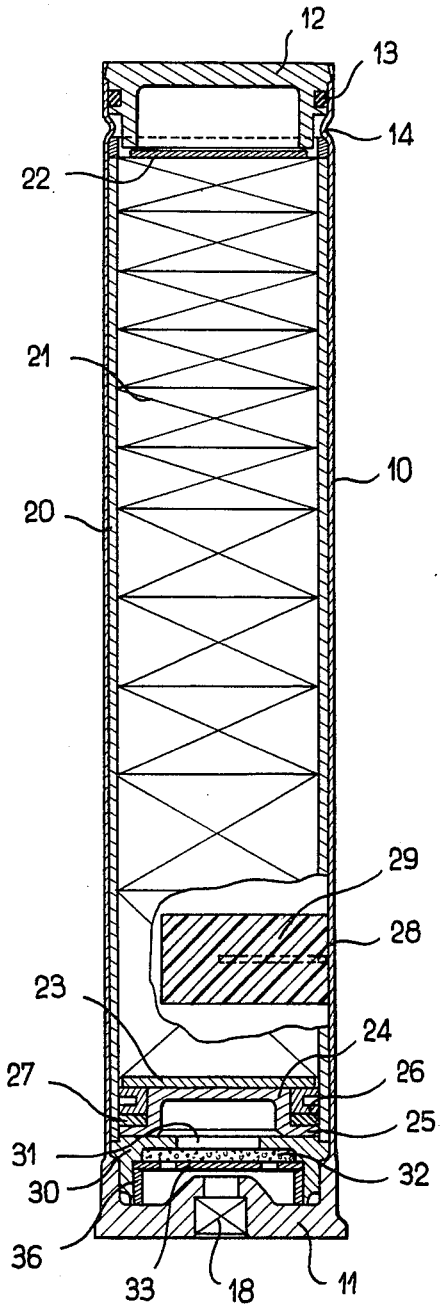
FIG. 1 is a general view of ammunition according to the present invention, the view being mainly in axial section, but with a non-sectional part showing a slit and reinforced adhesive tape sealing the slit.
Figure 3A:
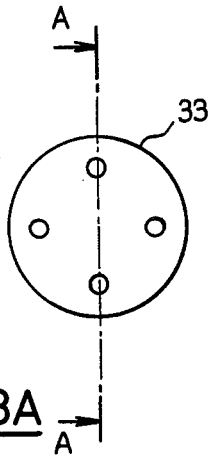
FIGS. 3A and 3B are respectively, a plan view and a section, of part of the unit of FIG. 2.
Figure 3B:
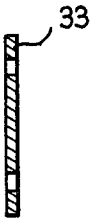
Figure 4:
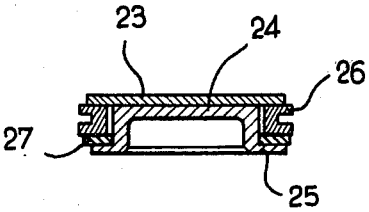
FIG. 4 is a section showing a thrust device.

In FIG. 1, reference 10 denotes the ammunition casing or outer body which in the example shown is a 40 mm casing. The base 11 of the casing is provided with a detonator 18 of electric or other type. Inside the casing 10, an impeller unit is mounted, constituted by members 30 to 36, and which will be described hereinbelow with reference to FIGS. 2 and 3. Above the impeller unit, a thrust device is mounted, constituted by members 23 to 27 which will be described hereinafter with reference to FIGS. 4 and 5.

The thrust device is housed in the bottom section of a tubular container 20 of plastics material, used to transfer the charge of decoy material from the charge manufacturing area to the place at which it is inserted into the ammunition. The tubular container 20, closely fitting into said outer body 10, has at the top a seal 22, made up, for example, of a disc of semi-rigid plastics material, and held by a plug 12 which is crimped at the upper end of the casing 10, with the interposition of sealing means at 13. At 14, the casing 10 is also crimped to ensure the axial retention of the tubular container 20 inside the casing 10. Finally, at 28, there is shown a sawing line used to adjust the length of the charge, the sawing line being sealed by reinforced plastics tape 29.

Figure 5A:
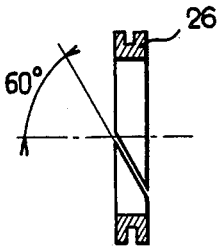
FIGS. 5A and 5B are respectively, a section and a plain view of part of the thrust device of FIG. 4.
Figure 5B:
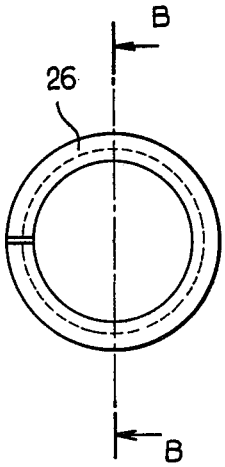

Consideration will now be given to FIGS. 1, 4 and 5A, 5B. At the bottom section of the tubular container 20, provision is made for a space which will be used to define the free volume of the release chamber for the gases produced by the impeller unit. In this space, the thrust device is housed. The thrust device comprises a semi-rigid disc 23 preferably of nylon, a flat face 24 of a thrust piston resting against the disc 23. The upper portion of the thrust piston is made up of the flat face 24, formed as a radial disc, the outer diameter of which is smaller than the inner diameter of the container 20. This radial disc is completed by a very short axial cylinder having the same diameter, while at the bottom, the thrust piston has an outwardly orientated annular projection 25, which defines an outer annular diameter which is practically equal to the inner diameter of the transfer container 20. As the projection 25 as well as the thrust disc 23 are both of a diameter very close to that of the container 20, and are axially separated, they delimit between them an annular space in which on the projection 25 side, a fireproof washer is lodged, made up preferably of felt or similar material. Above the washer on the semi-rigid disc 23 side, a split ring is provided for taking up mechanical play. As will be seen on FIGS. 5A and 5B, this ring has an outer annular recess, which gives it in axial section the shape of a U lying on its side. Moreover, the ring is split to 60° relative to its axial direction, as FIG. 5A shows. The size of the slit is of the order of 0.05 to 0.2 mm, for a ring the inner diameter of which is 24 mm, and the outer diameter is about 33 mm, whereas the depth of the peripheral recess of the ring is of the order of 2.5 mm. It has been found advantageous for this ring to be made of polyoxymethylene. The assembly of parts 26 and 27 is tightly enclosed between the projection 25 of the thrust piston and the semi-rigid disc 23.

Figure 2:
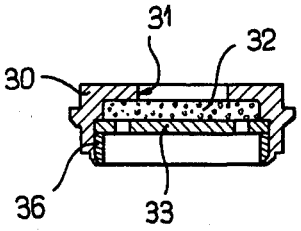
FIG. 2 is a section showing an impeller unit.

Consideration will now be given to FIGS. 1, 2 as well as 3A and 3B, for a description of the impeller unit. The gases from the electric detonator 18 are released into the enclosure situated at the lower part of the casing, this enclosure being delimited on the one hand by a cylindrical washer 36, and on the other hand by an axial disc 33, perforated by four fluid lamination apertures, the diameter of which is of the order of 3.5 mm. Between this part 33 and a boron ejection or propelling charge 32, an aluminium chip is provided which has advantageously a thickness close to 0.05 mm. In this manner, a lamination of gases is achieved, created by the electric detonator, which prevents these gases from becoming diffused throughout the ammunition, without having ignited the ejection charge beforehand. Furthermore, it will be noted that, account being taken of their small thickness, the chips have not been represented. Between the ejection charge 32 and the free volume provided for the expansion of the gases inside the thrust piston 24, there is an axial orifice 31, made in a part 30, which both acts as a housing for the boron charge 32, and defines the position of parts 36 and 33 already mentioned. Provision is again made for an aluminium chip, of a thickness close to 0.1 mm, between the ejection charge 32 and the axial orifice 31.

As soon as the upper chip yields, the gases generated rush at high speed through the central orifice 31, into the inner chamber delimited by the thrust piston 24, after which the latter acts upon the entirety of the decoy charge to make it slide inside housing 20, knock off the plug 12, and then eject the charge in its utilisation pattern.

An excellent ejection is obtained in spite of the manufacturing tolerances inherent in the tubular transfer container 20, its rather weak mechanical properties, and especially any propagation of the fire around the thrust member in the direction of the charge is avoided, which would seriously damage the nylon chips constituting the electro-magnetic decoy charge. Ring 26 provides means for taking up the play to define a correct positioning of the thrust member 24 inside the container 20, while felt washer 27, as was already indicated, ensures that the device is fireproof. Finally, the semi-rigid disc 23 transmits a plane force to the entirety of the charge, which permits ensuring the satisfactory dispersion of of the latter, without them becoming intermingled, which would reduce their properties considerably, as is apparent to those skilled in the art.

Advantageously, the surface presented by the four peripheral holes of the part 33 is close to one quarter the area delimited by the central orifice 31 of the part 30. Thus an optimum behaviour is ensured for the gases of the detonator relative to the propelling charge, without, on that account, these gases entering the charge of the electro-magnetic decoy.

When the thrust member goes beyond the level of slit 28, it has been observed that the gases could then come out through the slit, pass between the container 20 and the case 10, and then radially compress the container 20, which would prevent a satisfactory ejection of the charge. The use of a reinforced plastic tape 29 to seal this slit is sufficient to slow the gases down sufficiently for their charge ejection action to be faster than their passage outside the tubular container 20.

The embodiment described is particularly suitable as a 40 mm cartridge fired from an aircraft, in order to mislead air-to-air or ground-to-air radar systems.

The described construction of the thrust member from several parts (parts 23 to 27), enables a good thrust to be supplied complemented by good guiding inside the container 20, for a low mass. In addition, contrary to current ammunition of this type, only the charge (and the very low mass of the piston) is ejected. The assembly contributes towards the satisfactory operation of the ammunition.

The ammunition particularly described permits loading of the charge to be achieved in a very simple manner.

I claim:

1. Electro-magnetic decoy-launcher ammunition, comprising an outer body having a lower portion, impeller means in said lower portion of said body, thrust means, a charge of electro-magnetic decoy enclosed in said body to be ejected by said thrust means when the impeller means is excited, means defining a tubular transfer container in which the charge remains inside the outer body, said tubular transfer container being closely fitted into said outer body, said transfer container having a bottom portion, said thrust means comprising a thrust piston in said bottom portion of the transfer container, said thrust piston including means defining an internal downwardly directed recess, peripheral sealing means for providing a seal against the inner surface of the transfer container, a top defining a plane surface, and a semi-rigid disc co-operating with the plane surface of the thrust piston and in contact with the charge on its other side, said impeller means being disposed to cause the propelling agent to co-operate with the internal recess of the thrust piston.

2. Ammunition according to claim 1, wherein the thrust piston comprises an upper portion having a diameter smaller than the inner diameter of the tubular container, an integral bottom portion projecting radially outwards with a maximum diameter close to the inner diameter of the transfer container, said projection, and the semi-rigid disc defining an annular space therebetween, a fireproof washer in said annular space adjacent the annular projection, and a split ring in said annular space adjacent the semi-rigid disc to take up play, said washer and disc being tightly packed within the annular space.

3. Ammunition, according to claim 1, comprising means retaining the tubular container inside the outer body, and an ejectable sealing plug at the upper end portion of the ammunition.

4. Ammunition according to claim 1, wherein the impeller unit comprises a detonator, and an ejection charge both operative to generate gases, and fluid lamination means placed between the detonator in the ejection charge.

5. Ammunition according to claim 1, in which the transfer container comprises means defining a slit for adjusting, by cutting, the length of parts of the decoy charge, and reinforced adhesive tape sealing said slit.

* * * * *